United States Patent [19]

Longenecker

[11] 3,967,048

[45] June 29, 1976

[54] DUAL RING SUPPORTED ROOF FOR ELECTRIC ARC FURNACE

[76] Inventor: Levi S. Longenecker, 61 Mayfair Drive, Pittsburgh, Pa. 15228

[22] Filed: June 6, 1975

[21] Appl. No.: 584,631

[52] U.S. Cl. ..... 13/35; 13/32; 110/99 R

[51] Int. Cl.[2] ..... F27D 1/02

[58] Field of Search ..... 13/9, 10, 32, 35; 110/99 R, 99 A

[56] References Cited

UNITED STATES PATENTS

| | | | |
|---|---|---|---|
| 2,551,941 | 5/1951 | Greene | 13/35 X |
| 3,385,241 | 5/1968 | Alvis et al. | 110/99 A |
| 3,756,172 | 9/1973 | Brereton et al. | 13/35 X |

*Primary Examiner*—R. N. Envall, Jr.
*Attorney, Agent, or Firm*—Parmelee, Miller, Welsh & Kratz

[57] ABSTRACT

A dual-ring roof is provided for an electric arc furnace which may be suspended for lift-off and on operation with respect to a receiving mouth ledge portion about a charging opening in the furnace. The rings are radially spaced with respect to each other to define inner and an outer refractory tile receiving areas; they are of structural metal construction and have jacketing for continuous circulation of cooling fluid therealong. An outer, sprung, refractory skirt section is carried in the area between the rings, and the inner ring has an upwardly spaced relation with respect to the outer ring and carries centrally thereof an inner, refractory, sprung section or dome. The inner, central refractory roof section is provided with electrode and fume exhaust hole portions therein. The fume hole portion is enclosing and defined by a fluid-cooled ring through which fluid circulates in tandem with fluid being circulated through the inner roof ring. An overhead structural metal frame ties the inner and outer ring members together and may be utilized in suspending the roof.

20 Claims, 22 Drawing Figures

Fig. 10
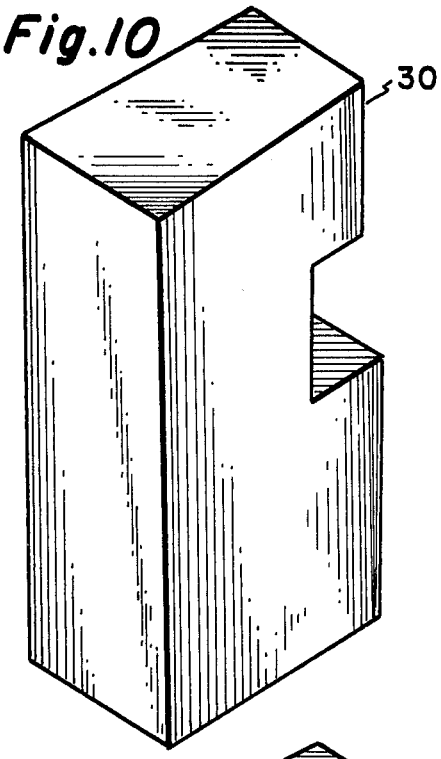
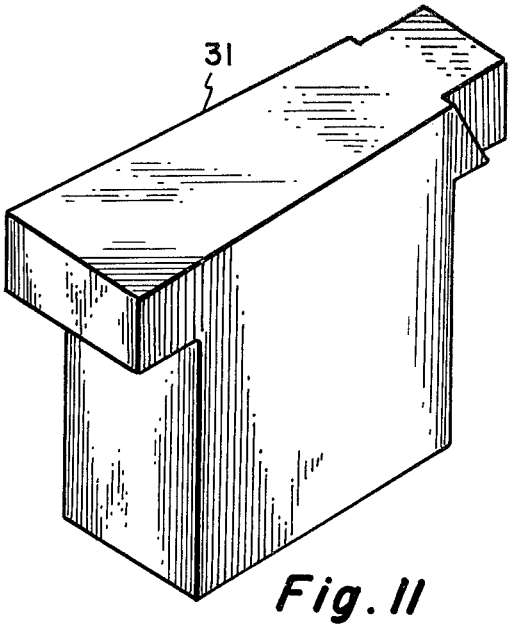
Fig. 11
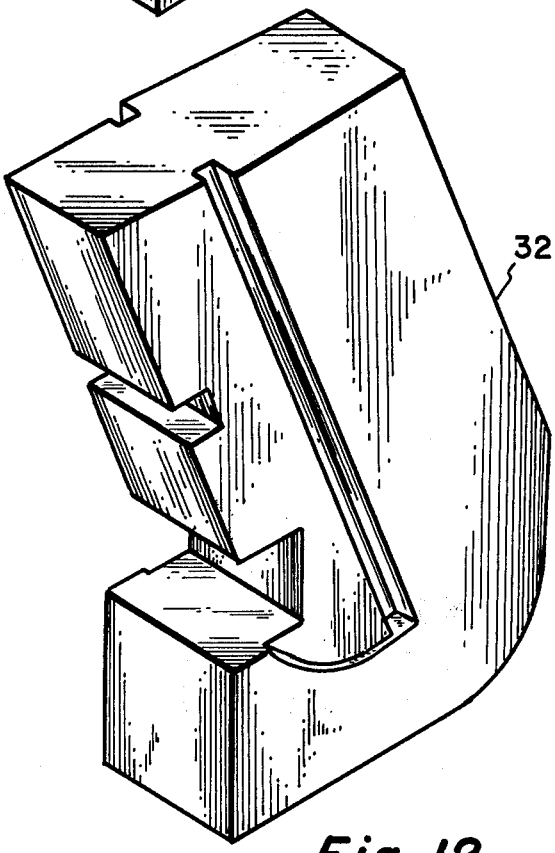
Fig. 12
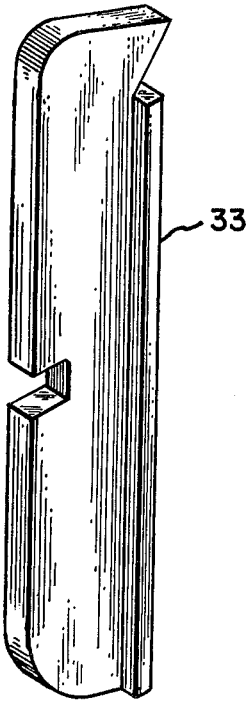
Fig. 13

DUAL RING SUPPORTED ROOF FOR ELECTRIC ARC FURNACE

BACKGROUND OF THE INVENTION

1. Field of the Invention

This invention relates to an improved furnace roof construction for an electric arc furnace and particularly, to a dual ring roof structure that is compartmentalized from the standpoint of its refractory tile or block members.

2. Description of the Prior Art

Heretofore, difficulties have been encountered in providing and maintaining the conventional sprung arch type of suspended roof for electric arc furnaces. The heavy compression thrust loading of such a type of roof has the tendency to crush the refractories and cause premature failure. This is especially true in view of the fact that a furnace roof has to be tilted about 45° when the furnace is tapped. In the sprung crown, thin roof areas tend to produce structural weaknesses that will cause the whole roof to collapse. It is also desirable to enable the use of basic brick which can better withstand high temperature and basic slag vapors. However, basic tile or brick has not heretofore been fully satisfactory when used in a roof having the high compression characteristics of a conventional sprung type.

In evaluating the problem, it has been determined that there is a need for an improved type of roof which will enable the maximized cooling of metal structure and, at the same time, which will divide the refractory load in such a manner as to minimize stress and strain on the tile or block members and enable the successful use of so-called basic brick. The difficulty in finding a solution to the problem was found to rest upon the need for proportioning or dividing up the refractory load and in such a manner as to avoid an added appreciable increase in weight of the roof and assure a good operating life from the standpoint of structural metal members employed.

SUMMARY OF THE INVENTION

It has thus been an object of the present invention to determine the factors that give rise to the problem presented in connection with the use of fully sprung suspended roof constructions for electric arc furnaces, to evaluate such factors and devise a practical solution to the problem.

Another object has been to devise a practical roof structure that will enable a dividing up of the supporting function of the ring structure and in such a manner as to carry the refractory portions with minimization of stress and strain thereon.

A further object of the invention has been to devise a dual ring furnace roof construction in which the refractory portions thereof are carried as an outer skirt between the rings and as an inner central area within an inner one of the rings.

A further object of the invention has been to devise an electric arc furnace roof whose refractory sprung area is sectionalized and is provided with maximized support, all in such a manner as to compare favorably in overall weight to the overall weight of a conventional single ring supported sprung roof structure.

A still further object of the invention has been to provide an improved furnace roof for an electric arc furnace.

These and other objects of the invention will appear to those skilled in the art from the illustrated embodiment and the claims.

BRIEF DESCRIPTION OF THE DRAWINGS

FIG. 10 is a further enlarged perspective view in elevation of a recessed refractory latching block or tile member which is adapted to be carried on the lower flange of an inner ring member of the construction shown in FIG. 6;

FIG. 11 is a perspective view in elevation on the scale of FIG. 10 showing the construction of a T-shaped refractory block member that is carried beneath the lower flange of the inner ring member shown in FIG. 6, and which is adapted to latch with the block of FIG. 10 and the block of FIG. 12;

FIG. 12 is a perspective view in elevation on the scale of FIGS. 10 and 11, illustrating a skew-back block that is adapted to carry outer reaches of block or tile members of a central or domed refractory portion of the roof structure as shown in FIGS. 6 to 9, inclusive;

FIG. 13 is a perspective view in elevation on the scale of FIGS. 10 to 12, inclusive, illustrating details of the construction of a metal skew-back casting that is shown in FIGS. 6 to 9, inclusive, and is adapted to fit on and latch-engage with the inner ring structure for carrying blocks of FIG. 12;

Figure 16:
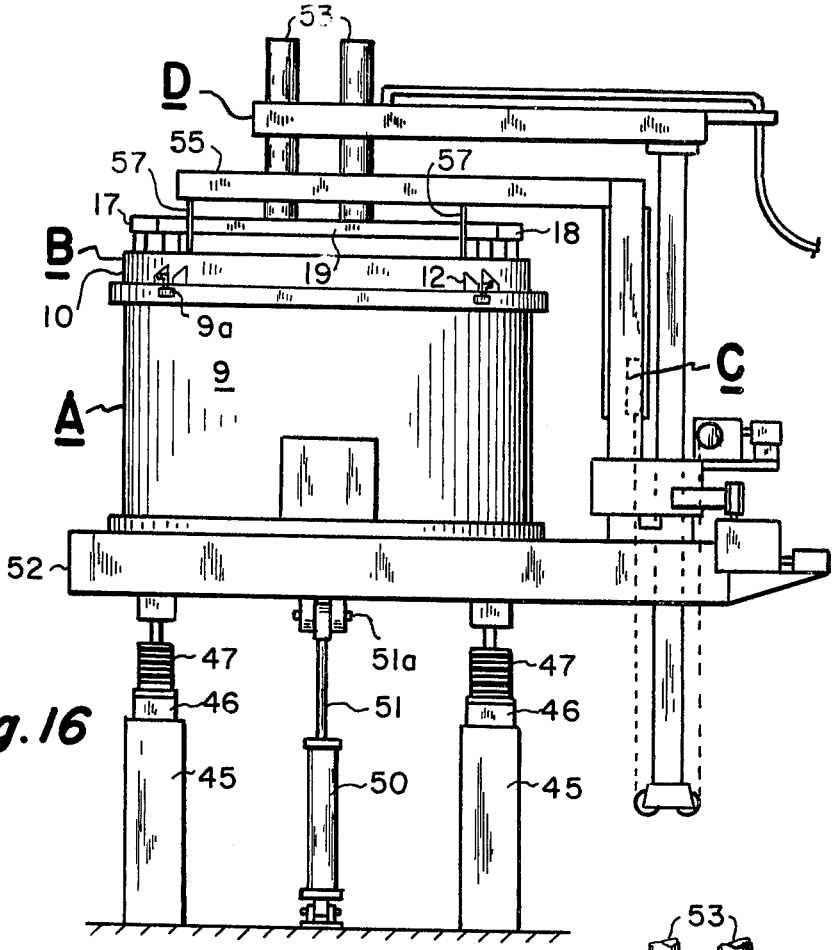
FIG. 16 is an elevation on a reduced scale showing a furnace roof of the invention in a typical utilization with a tiltable electric arc furnace that has means for lowering, raising and swinging the roof in a suspended relation.
Figure 18:
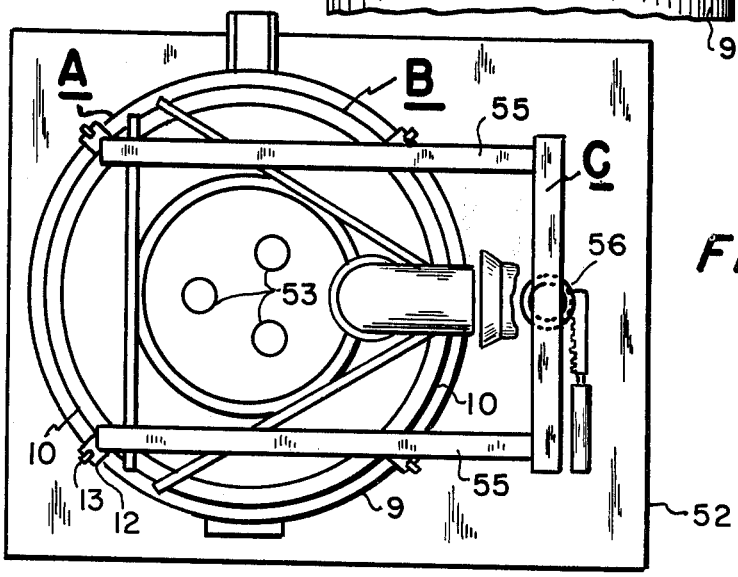

And, FIG. 18 is a top plan view on the same scale as and of the furnace assembly of FIG. 16.

DESCRIPTION OF THE PREFERRED EMBODIMENTS

In carrying out the invention, a continuous circular, circumferential or outer supporting metal ring member 10 is utilized with an inwardly and upwardly spaced ring member 15 of somewhat similar construction. A triangular-shaped, overhead, supporting metal cross frame 17, 18, 19 is connected between the ring members for securing them together as a rigid structure. Fluid or water-circulating jacketing or flow chambers *a* and *b* are provided along the rings 10 and 15. A fume or smoke hole metal supporting ring member 20 of box-like section has a cooling fluid jacketing or flow chamber *c* that is shown connected in series or tandem with the jacketing *b* of the inner ring 15. A group of electrode by-passing or receiving, refractory-lined hole portions are provided within a central, dome-shaped refractory roof section or area that is suspended or carried within the inner ring 15. An outer refractory roof section or area is suspended or carried between the inner and outer rings 15 and 10. The support frame as made up of members 17, 18 and 19 may be suspended (see FIGS. 16 to 18) by connecting tie rods 57 from a conventional roof carrying frame 55.

Figure 1:
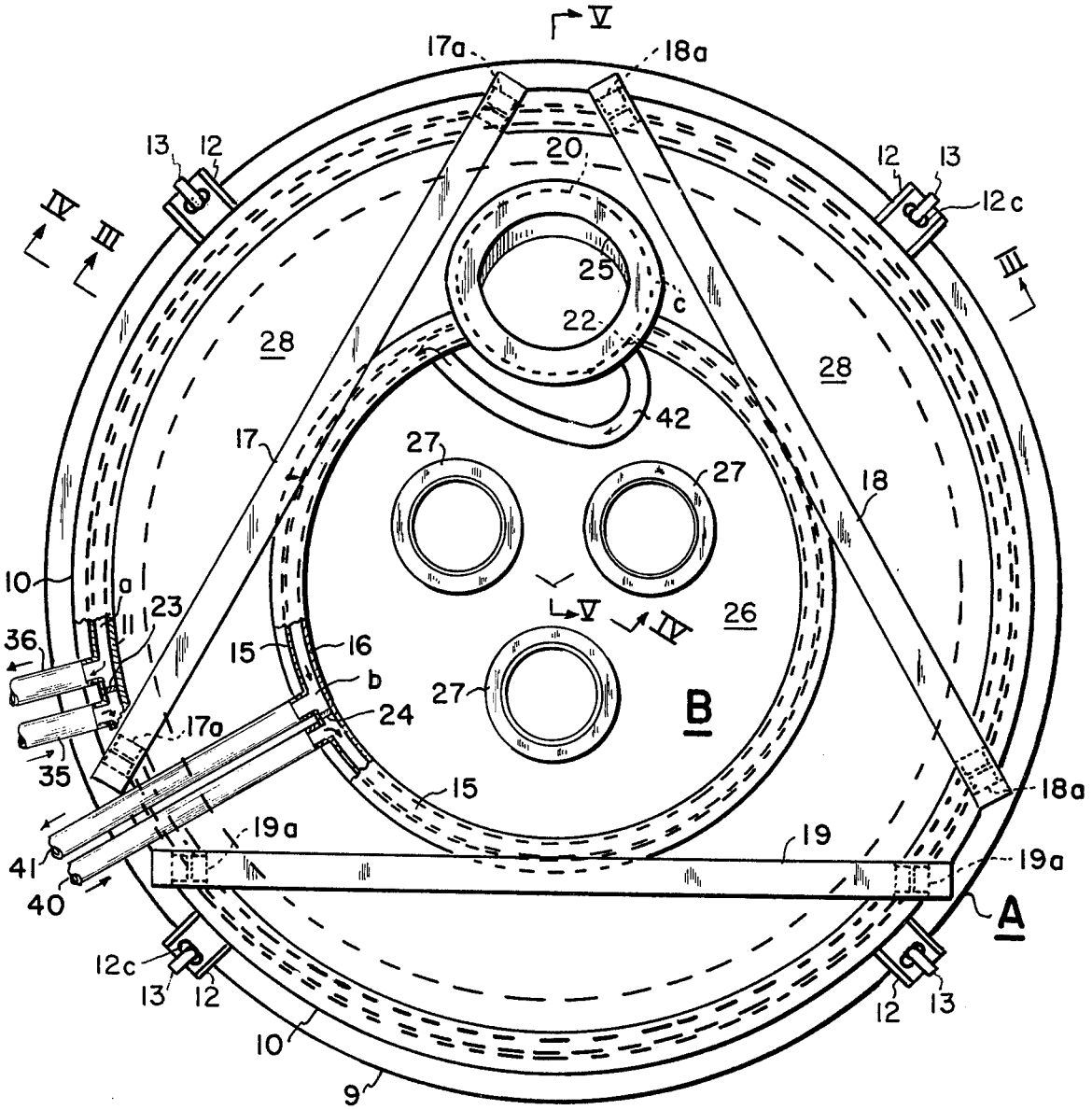
FIG. 1 is a top plan view in partial section of a furnace roof constructed in accordance with the invention.
Figure 2:
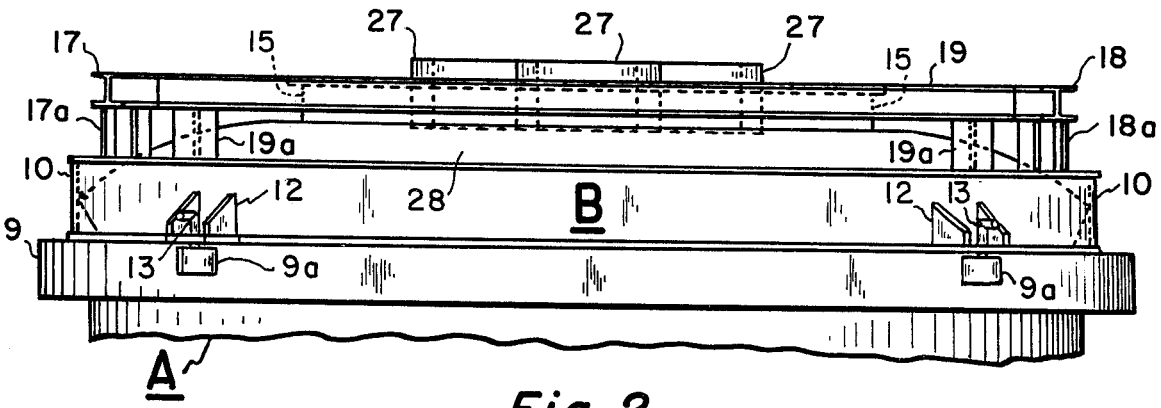
FIG. 2 is a fragmental side elevation on the same scale as and showing the roof of FIG. 1.

Referring particularly to FIGS. 1, 2 and 16 of the drawings, an electric arc furnace A of rounded configuration is shown mounted for tilting action in connection with metal pouring and the slag removing operations, and as provided with a furnace roof B of the invention. The roof B is shown of continuous or circular construction defined by the outer roof ring 10 of channel-shape (see also FIGS. 3, 4 and 5) whose bottom flange is adapted to engage or rest upon a substantially planar, mouth ledge portion 9 about the charging opening of the furnace A. The jacketed or enclosed cooling fluid circulating chamber *a* along the outer ring 10 is of triangular shape as provided by a diagonally extending or sloped, metal closure member or strip 11 that is welded between an outer end of the lower flange and a central portion of the web of the ring 10. The diagonal member 11, as shown particularly in FIGS. 4 and 5, serves as an outer or peripheral support for a first, outer, apron group or assembly of refractory tile or block members 28 which cover the area between the outer ring member 10 and the inner ring member 15. To facilitate the retention of an outermost row of refractory tile members 28, the diagonal member 11 is provided with a series of spaced-apart, pin-like projections or key portions 11*a* that fit within corresponding latching hole portions in the tile of such row.

Figure 3:
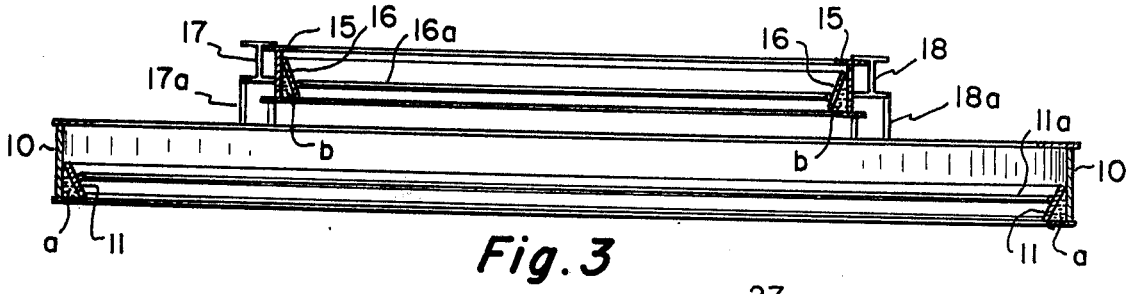
FIG. 3 is a section on the same scale as and taken along the line III—III of FIG. 1, with refractories omitted to particularly illustrate structural members.
Figure 4:
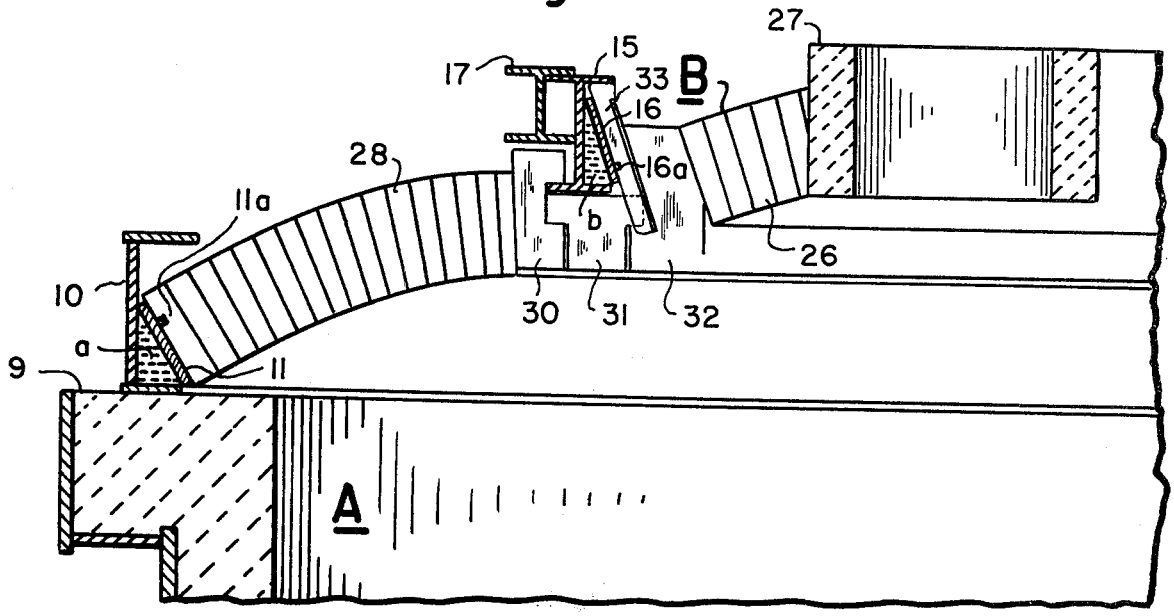
FIG. 4 is an enlarged fragmental section in elevation taken along the line IV—IV of FIG. 1 and particularly illustrating the mounted relationship between refractory and structural frame members.
Figure 5:
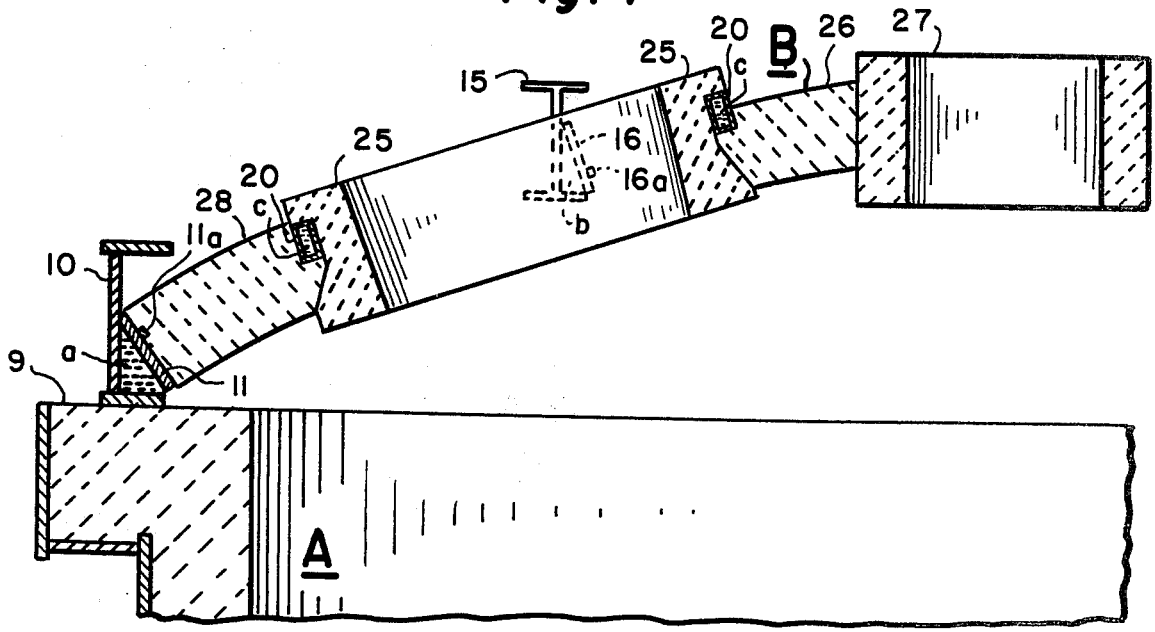
FIG. 5 is an enlarged fragmental section in elevation on the scale of FIG. 4 and taken along the line V—V of FIG. 1, particularly illustrating a smoke hole portion and like FIG. 4, an electrode by-passing hole portion.
Figure 6:
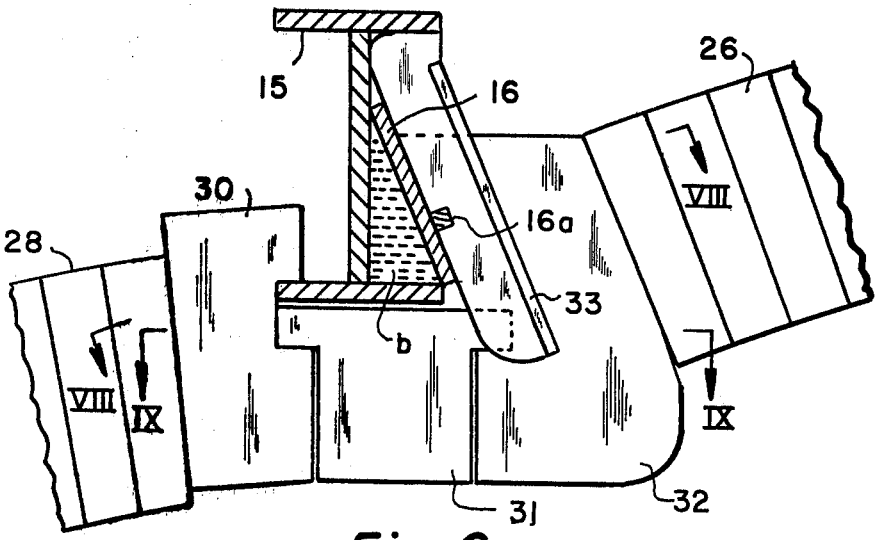
FIG. 6 is a greatly enlarged vertical fragmental sectional detail showing inner and outer refractory ties with an inner ring member of the construction.
Figure 7:
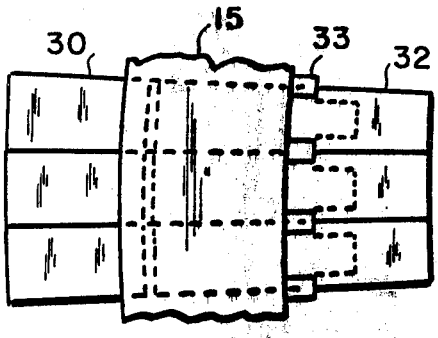
FIG. 7 is a fragmental plan view on the same scale and of the structure shown in FIG. 6.
Figure 8:
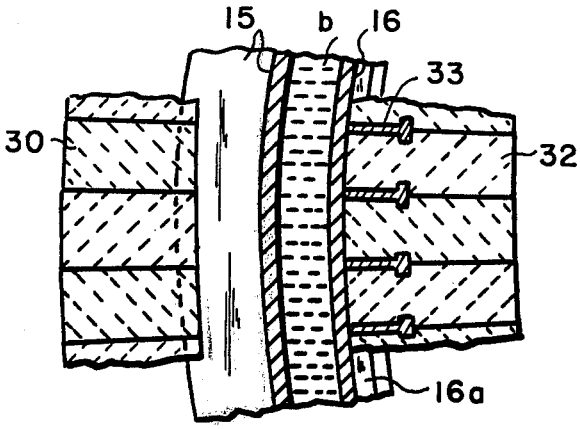
FIG. 8 is a horizontal section on the scale of and taken along the line VIII—VIII of FIG. 6.
Figure 9:
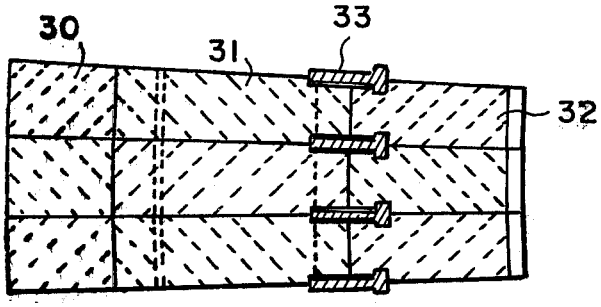
FIG. 9 is a fragmental horizontal section on the same scale as and taken along the line IX—IX of FIG. 6.
Figure 14:
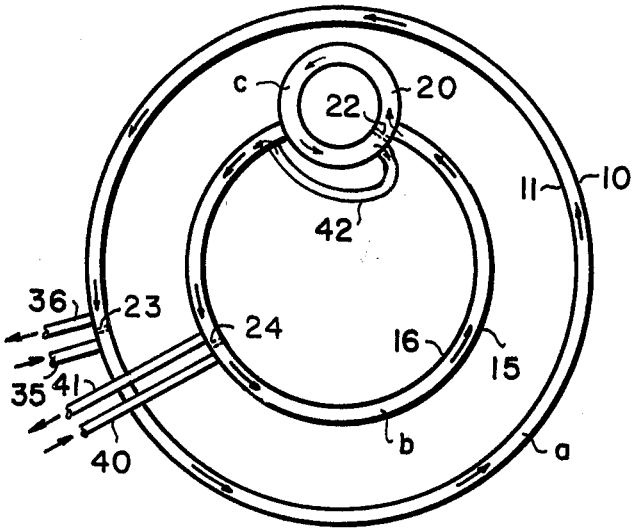
FIG. 14 is a greatly reduced horizontal schematic illustrating fluid or water cooling of inner and outer ring members, as well as of a smoke hole ring member of the construction of FIGS. 1 and 2.
Figure 14A:
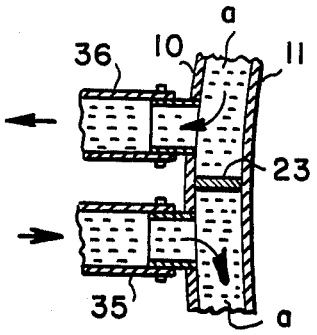
FIGS. 14A, 14B and 14C are enlarged fragmental horizontal sections taken respectively along selected portions or areas as indicated on FIG. 14 to illustrate fluid connections and flow patterns.
Figure 14C:
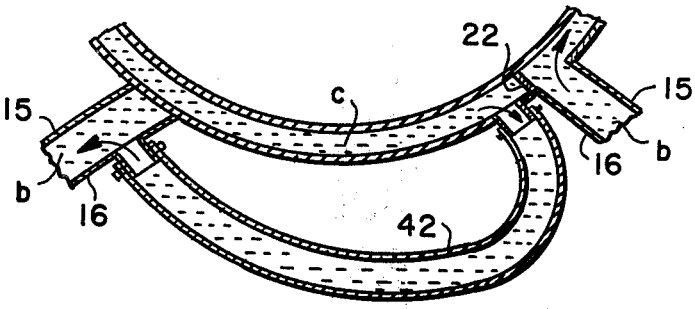
Figure 14B:
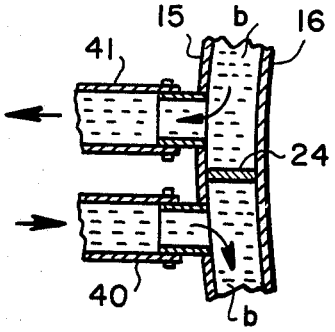
Figure 15A:
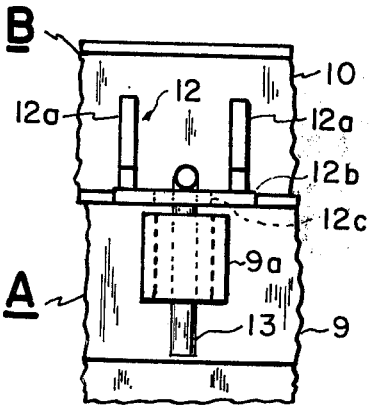
FIG. 15A is a fragmental front view in elevation on the same scale as and of the structure shown in FIG. 15.
Figure 15:
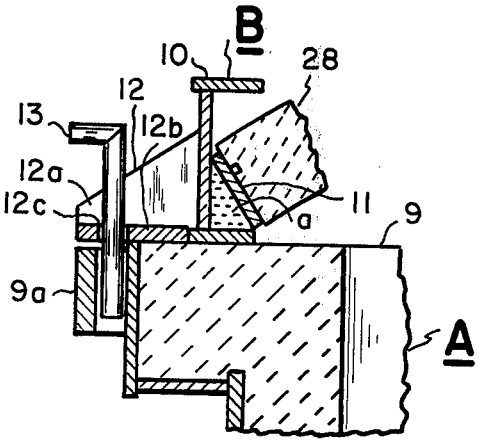
FIG. 15 is a fragmental side section in elevation on the scale of FIGS. 4 and 5, illustrating lock pin and gusset means that may be spaced about the outer ring of the roof for latching it in position on top of a furnace.

The inner ring member 15, as particularly illustrated in FIGS. 4, 5 and 6, is shown of I-beam construction and is illustrated in FIGS. 1 and 3 as extending continuously about the roof in an inwardly and upwardly spaced relation with respect to the outer ring 10. It, like the outer ring 10, has a continuous cooling fluid circulating chamber, jacket or enclosed passageway *b.* As shown, a diagonal, longitudinally-extending metal closure member or strip 16 is weld-secured to extend from an upper portion of the web to an inner edge of the bottom flange of the inner ring member 15.

The three structural support members 17, 18, and 19 of I-beam shape, as particularly shown in FIG. 1, converge towards their ends to provide a somewhat triangular-shaped overhead frame that is rigidly secured in a tangential relation with respect to the inner ring member 15 and in an endwise relation with respect to the outer ring member 10. As shown particularly in FIGS. 1, 2 and 3, the outer ends of the structural beams 17, 18 and 19 are provided with a pair of box-like vertical spacers, respectively, 17*a*, 18*a* and 19*a*, which are welded in position between the ends of the structural beams and the upper flange of the outer ring member 10.

As shown particularly in FIGS. 1 and 5, the metal ring 20 is of box-like, circular shape to extend about a smoke or fume exhaust hole portion in the furnace roof and internally thereof has a cooling fluid circulating jacket, chamber or passageway *c* therealong. A refractory collar or ring 25 is latched over the metal ring 20 and carried in a depending relation therefrom. The refractory collar 25 is made up of a continuous row or series of abutting block members of the construction shown in FIG. 5. As indicated in FIG. 1, by way of representation, three electrode hole portions are provided as defined by refractory rings 27. See also FIGS. 4 and 5.

As shown in FIGS. 4 and 5, refractory tile members 26 and 28 of the inner and outer or center and apron roof sections are of substantially planar wide-face construction, and are arched into position between the metal members and interlocking refractory block members adjacent the inner ring member 15. Also, the tile 26 may be cut to provide a suitable closing-off fit with refractory blocks 25 about the fume hole portion and with the refractory rings 27 about the electrode hole portions.

A row of T-shaped refractory block members 31, see particularly FIGS. 4 and 11, are adapted to extend along the lower reaches of the lower flange of the inner ring member 15 to not only protect the member from the furnace heat, but to also latch-engage with a row of refractory key, U-shaped latching blocks 30 (see FIG. 10) which define inner reaches of the tiles 28 of the outermost tile member assembly. The blocks 30 latch over one shoulder of the blocks 31 and over the outer portion of the bottom flange of the metal ring 15. A series of metal skew-back castings 33 (see FIGS. 4, 6 and 13) latch under the inner most portion of the upper flange of the inner ring member 15, extend vertically along the diagonal member 16 and latch-receive a row of skew-back refractory blocks 32 (see also FIG. 12). A vertical flange or foot portion 33*a* of each metal casting 33 is adapted to latch-engage within vertical side slot portions 32*a* of adjacent pairs of refractory blocks 32, and its notch portion 33*b* is adapted to align with notch portions 32*b* of the blocks 32 that latch on a projecting ledge or rim 16*a* along the member 16 (see FIG. 4). The skew-back blocks 32 rest against the face of the diagonal member 16 and have a lower notch that latch-engages the innermost shoulder of the T-shaped blocks 31. The spacing defined by the web portion of each hanger 33 may be closed-off by conventional refractory filler material or cement.

Referring to FIGS. 2, 15, 16, 17 and 18, the roof B may be latched in a "down" position by four heavy latching pins 13 at, for example, 90° spaced positions along the top lip portion 9 of the furnace A. As shown, a group of quadrant-positioned gussets 12, each having a horizontally spaced-apart pair of upright or wing flanges 12*a*, project outwardly from the ring 10. A bottom flange 12*b* of each gusset 12 is adapted to rest on the lip portion 9 of the furnace A. The metal housing of the furnace A has a group of four, equally spaced-apart latching sockets 9*a* (see FIGS. 1, 2, 15 and 15A) that are adapted to receive latching pins 13. Each pin 13 extends through a hole portion 12*c* in the bottom plate or foot portion 12*b* of an associated gusset 12.

FIGS. 1, 14 and 14*a* through 14*c* are illustrative of cooling fluid circulating systems of the structure. Cooling water is shown introduced through a flexible metal inlet pipe or tubing member 35 into the chamber *a* of the outer ring 10 to circulate thereabout and exhaust through a second flexible metal pipe or tubing member 36. A cross-extending baffle piece 23 closes-off the inlet and outlet ends of the circular circulating system with respect to each within the chamber *a*. In a like manner, the inner ring member 15 is supplied with cooling fluid or water through flexible water pipe or tubing 40 and warmed, circulated fluid or water is exhausted through flexible pipe or tubing 41. A baffle 24 is also positioned intermediate the inlet and outer ends of the chamber *b*.

The box-like metal ring 20 of the fume or smoke hole portion of the furnace is supplied with cooling fluid or water at one separated or cut-off end of the ring member 15 to circulate thereabout and exhaust through a branch line or pipe member 42 that serves as a cross-connection from one end of the chamber *c* of the ring 20 with the other cut-off end of the chamber *b* of the inner ring 15. As shown particularly in FIG. 14C, baffling 22 closes-off the chamber *c* adjacent the inlet from ring member 15, and the wall of the ring 20 closes-off the other end of the chamber *b* adjacent its connection to the branch line 42. This provides a continuous in-line or tandem flow of cooling fluid from the chamber *b* of the ring member 15 along the chamber *c* of the ring member 20 and then through, along and out of the chamber *b* of the ring member 15.

Figure 17:
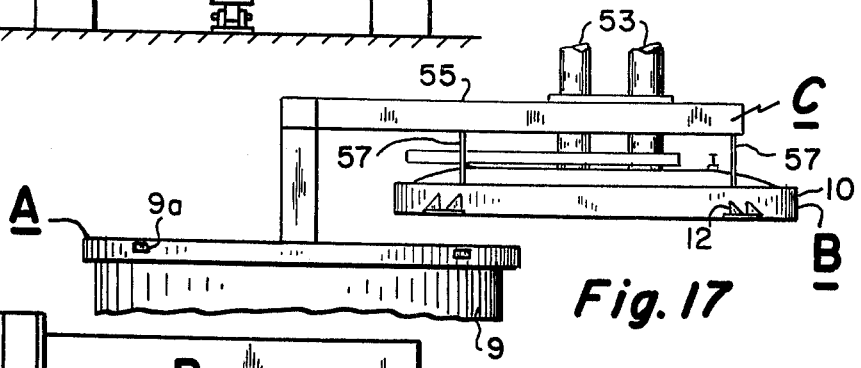
FIG. 17 is a fragmental view in elevation on the scale of FIG. 16 and showing the furnace roof in a raised and outwardly swung relation with respect to a mouth ledge portion of the furnace.

With particular reference to FIGS. 16, 17 and 18, representative electric arc furnace A (such as, for example, produced by Swindell-Dressler) is shown to particularly illustrate the positioning of the roof B with respect thereto. The body of the furnace A is carried on a base portion 52 which is provided with a pair of outwardly, convexly rounded, gear teeth segments 47 that cooperate with planar gear teeth segments 46 that are carried on strands 45 to enable tilting of the furnace about 45° in a conventional manner for pouring the charge. A fluid motor 50 is connected by a piston 51 and a pivot connection 51*a* for actuating the tilting operation of the platform or base 52. A conventional system for raising and lowering furnace roof B is also illustrated and makes use of a rear-end positioned elevating frame C that is motor driven to raise a ram ratchet and thus, to raise and lower the roof B. Also, a turntable is shown for swinging away the roof B from and towards the furnace A. An angularly-shaped overhead support D is shown for arc-producing electrodes 53. The elevating frame C may carry the overhead rectangular frame 55 which is shown secured to the structural frame of the roof B by the group of spacer pins 57.

I claim:

1. In an improved roof for an electric arc furnace and the like having a mouth ledge portion and wherein the roof is to be lowered and lifted into and out of position with respect to the ledge portion of the furnace, an outer fluid-cooled metal roof ring member adapted to rest on the ledge portion, an inner metal roof ring member in a radially-inwardly spaced relation with respect to said outer ring member, a first group of refractory tile members defining a central roof within the confines of and supported by said inner ring member, said central roof having electrode and fume exhaust hole portions therein, a second group of refractory tile members defining a roof skirt positioned between said inner and outer ring members, an overhead structural metal frame extending over the first and second groups of tile members and securing said inner ring member in an upwardly offset and connected relation with respect to said outer ring member.

2. In an improved roof as defined in claim 1, said first and second groups of refractory tile members having a sprung-mounted positioning between and with respect to said inner and outer ring members.

3. In an improved roof as defined in claim 2, skew-back castings carried by said inner ring member, and skew-back refractory blocks cooperating with said castings for positioning said first group of refractory tile members with respect to said inner ring member.

4. In an improved roof as defined in claim 2, T-shaped refractory blocks cooperating with said inner ring member and said skew-back castings, and latching refractory blocks cooperating with said T-shaped blocks and said inner ring member for positioning said second group of refractory tile members with respect to said inner ring member.

5. In an improved roof as defined in claim 1, skew-back castings carried by said inner ring member, skew-back refractory blocks cooperating with said skew-back castings for positioning said first group of tile members with respect to said inner ring member, intermediate refractory blocks along said inner ring member interfitting with said skew-back blocks, and latching refractory blocks interfitting with said intermediate blocks and said inner ring member for positioning said second group of tile members with respect thereto.

6. In an improved roof as defined in claim 1, said roof skirt having members along its inner and outer reaches that support it between and on said inner and outer ring members, and said central roof having members along its outer reaches that support it on said inner ring member.

7. In an improved roof as defined in claim 1, said outer ring member having an enclosed cooling chamber therealong, and flexible means connected to said outer ring member for supplying cooling fluid thereto and for exhausting warmed fluid therefrom.

8. In an improved roof as defined in claim 1, said inner ring member having a cooling chamber therealong, and flexible means for supplying cooling fluid to and exhausting warmed fluid from said chamber.

9. In an improved roof as defined in claim 8, an enclosing metal ring about the fume exhaust hole portion of said central roof and supporting the roof thereat.

10. In an improved roof as defined in claim 9, said enclosing ring having a cooling chamber therealong, and means connecting the cooling chamber of said inner ring member in a tandem flow relation with the cooling chamber of said enclosing ring.

11. In an improved roof as claimed in claim 10, said outer ring member having a cooling chamber extending therealong and in an adjacent relation with respect to said roof skirt, and flexible hose means for supplying cooling fluid to said outer ring member and for removing warmed fluid therefrom.

12. In a improved roof as defined in claim 1, said inner and outer ring members being of I-beam construction and each having a cooling chamber therealong that is defined by a diagonally secured plate member positioned between an outer edge of a flange of the beam and an opposite portion of the web thereof.

13. In an improved roof as defined in claim 1, said inner and outer ring members having cooling fluid chamber portions therealong, a continuous ring about the fume exhaust hole portion for supporting adjacent refractory tile members of said central roof thereon, and said continuous ring being of box-like cross section therealong to define a cooling fluid chamber about the fume exhaust hole portion.

14. In an improved roof as defined in claim 13, said inner ring member having a pair of split end portions at said continuous ring and at one split end portion having its cooling chamber portion connected to the cooling chamber of said continuous ring, said continuous ring having a baffle adjacent the point of connection of said inner ring member thereto, and a pipe member extending from adjacent said baffle to connect with the other split end portion of said inner ring member for returning cooling fluid from said continuous ring to said inner ring member.

15. In an improved roof as defined in claim 1, said overhead metal frame comprising a group of structural frame members, each of which is substantially centrally secured to said inner ring member and is secured at its opposite ends to said outer ring member.

16. In an improved roof as defined in claim 1, said overhead frame comprising a pair of oppositely positioned diagonally extending I-beam members and a cross-extending I-beam member positioned adjacent diverging end portions of said pair of diagonal beam members, and each said beam member of the said frame being secured to extend substantially centrally from said inner ring member and being secured at its opposite ends to said outer ring member.

17. In an improved roof as defined in claim 1, skew-back castings and interfitting refractory blocks carried by said inner ring member along opposite sides thereof for respectively suspending an outer perimeter of said central roof and an inner periphery of said roof skirt on and with respect to said inner ring member.

18. In an improved roof as defined in claim 17, said central roof constituting a larger width dimension of the suspended roof and being of a sprung crown construction as positioned on said inner ring member, and said roof skirt being of lesser width dimension than said central roof and also being of sprung construction as positioned between said inner and outer ring members.

19. In an improved roof as defined in claim 1, skew-back castings resting along an inner side of said inner ring member, skew-back refractory blocks having sloped walls terminating in outwardly offset foot portions that latch-engage inwardly of and with said skew-back castings, and said skew-back blocks supporting an outer side of said central roof.

20. In an improved roof as defined in claim 19, T-shaped refractory blocks positioned beneath to extend along said inner ring member in abutment with said skew-back castings and the foot portions of said skew-back blocks, and channel-shaped refractory blocks having recess portions that fit on said inner ring member in engagement with said T-shaped blocks to abut innermost reaches of said roof skirt.

* * * * *